US007438595B2

(12) United States Patent
Saito

(10) Patent No.: US 7,438,595 B2
(45) Date of Patent: Oct. 21, 2008

(54) SMALL-SIZED ELECTRICAL CONNECTOR EASILY IMPROVED IN EMI CHARACTERISTICS

(75) Inventor: Yuichi Saito, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 0 days.

(21) Appl. No.: 11/543,376

(22) Filed: Oct. 5, 2006

(65) Prior Publication Data

US 2007/0082554 A1 Apr. 12, 2007

(30) Foreign Application Priority Data

Oct. 6, 2005 (JP) ..... 2005-294006

(51) Int. Cl.
*H01R 13/648* (2006.01)

(52) U.S. Cl. ..... 439/607; 439/609; 439/357

(58) Field of Classification Search ..... 439/607, 439/609, 357, 608, 610
See application file for complete search history.

(56) References Cited

U.S. PATENT DOCUMENTS 4,718,867 A * 1/1988 Seidel et al. ..... 439/609
5,319,156 A * 6/1994 Fonteneau et al. ..... 439/609
5,356,301 A * 10/1994 Champion et al. ..... 439/108
5,733,146 A * 3/1998 Block ..... 439/610
5,961,350 A * 10/1999 Shiu ..... 439/607
6,135,815 A * 10/2000 Ko et al. ..... 439/607
6,234,827 B1 5/2001 Nishio et al.
6,270,379 B1 * 8/2001 Huang et al. ..... 439/660
6,645,011 B2 * 11/2003 Schneider et al. ..... 439/609
2001/0012718 A1 * 8/2001 Nishimatsu ..... 439/378
2004/0115990 A1 * 6/2004 Kodama ..... 439/607

FOREIGN PATENT DOCUMENTS

JP 07-220803 A 8/1995
JP 11-509969 A 8/1999
JP 2000-223218 A 8/2000
JP 2003-229212 A 8/2003

OTHER PUBLICATIONS

A Japanese Office Action (and English translation therof) dated Apr. 23, 2008, issued in a counterpart Japanese Application.

* cited by examiner

*Primary Examiner*—Gary F. Paumen
(74) *Attorney, Agent, or Firm*—Frishauf, Holtz, Goodman & Chick, P.C.

(57) ABSTRACT

In an electrical connector to be connected to a mating connector having a locking portion for locking a connected state between the electrical connector and the mating connector, a conductive shell includes a recessed portion adapted to be engaged with the locking portion in the connected state. The recessed portion has a bottom adapted to come into contact with the locking portion in the connected state. The conductive shell is coupled to a housing holding a contact.

9 Claims, 7 Drawing Sheets

SMALL-SIZED ELECTRICAL CONNECTOR EASILY IMPROVED IN EMI CHARACTERISTICS

This application claims priority to prior Japanese patent application JP 2005-294006, the disclosure of which is incorporated herein by reference.

BACKGROUND OF THE INVENTION

This invention relates to an electrical connector and, in particular, to a connector having a locking function of locking the connector to a mating connector through their shells.

A connector of the type may be used as a high-speed transmission interface connector and is disclosed, for example, in Japanese Unexamined Patent Application Publication (JP-A) No. 2003-229212. In the connector disclosed in the publication, a cable connector includes a plurality of contacts supported by a housing, a shell comprising a box-shaped metal member and surrounding the contacts, and a resin hood covering a whole of the connector. The shell is formed by bending a sheet metal plate and has a rectangular locking hole.

When the cable connector is connected to a mating connector, a part of a spring member formed on the mating connector is fitted to the locking hole. By engagement between the locking hole and the spring member, the cable connector and the mating connector are locked to each other in a connected state. A locking mechanism of the type has no mechanical action upon fitting and is generally called friction lock.

In the electrical connector using the friction lock, contact between the shells of the cable connector and the mating connector is not expected at a portion of the friction lock. Therefore, in order to improve EMI characteristics by obtaining the contact between the shells of the cable connector and the mating connector, a contacting spring member must be formed at a position different from the portion of the friction lock.

However, if the spring member for the friction lock and the contacting spring member for improving the EMI characteristics are separately provided, the electrical connector is increased in size. In particular, in a small-sized interface connector, a space for arranging the spring members is limited. It is therefore difficult to provide both the spring member for the friction lock and the contacting spring member for improving the EMI characteristics.

SUMMARY OF THE INVENTION

It is therefore an object of this invention to provide an electrical connector which can easily be improved in EMI characteristics although friction lock is used.

It is another object of this invention to provide a small-sized electrical connector suitable as a high-speed transmission interface connector.

Other objects of the present invention will become clear as the description proceeds.

According to an aspect of the present invention, there is provided an electrical connector to be connected to a mating connector including a spring member having a locking portion for locking a connected state between the electrical connector and the mating connector. The electrical connector comprises a conductive contact, a housing holding the contact, and a conductive shell coupled to the housing and covering the contact; the shell including a recessed portion adapted to be engaged with the locking portion in the connected state, the recessed portion having a bottom adapted to come into contact with the locking portion in the connected state.

DRAWING DESCRIPTION OF THE DRAWING

DESCRIPTION OF THE PREFERRED EMBODIMENTS

Figure 1:
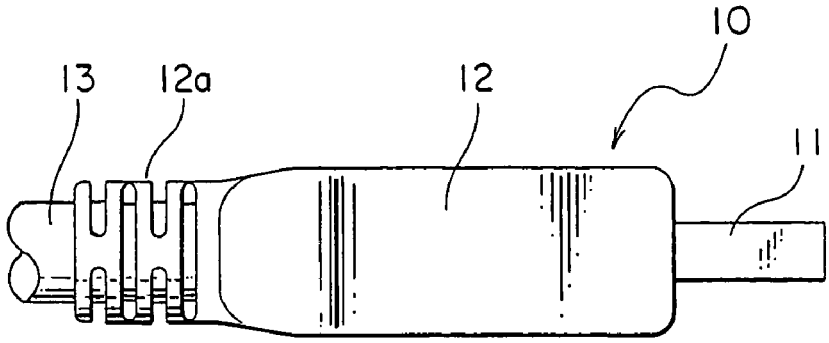
FIG. 1 is a side view of an electrical connector according to a first embodiment of this invention when a cable is connected thereto.
Figure 2:
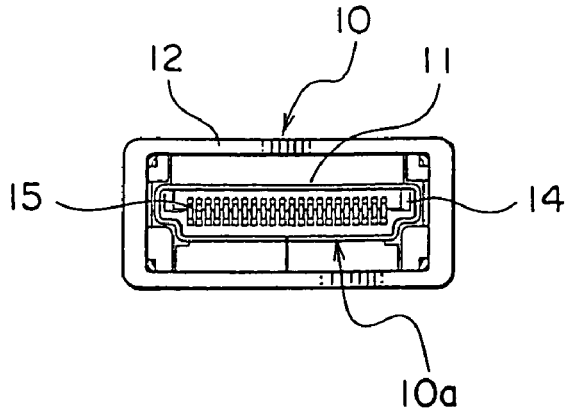
FIG. 2 is a front view of the electrical connector illustrated in FIG. 1.
Figure 3:
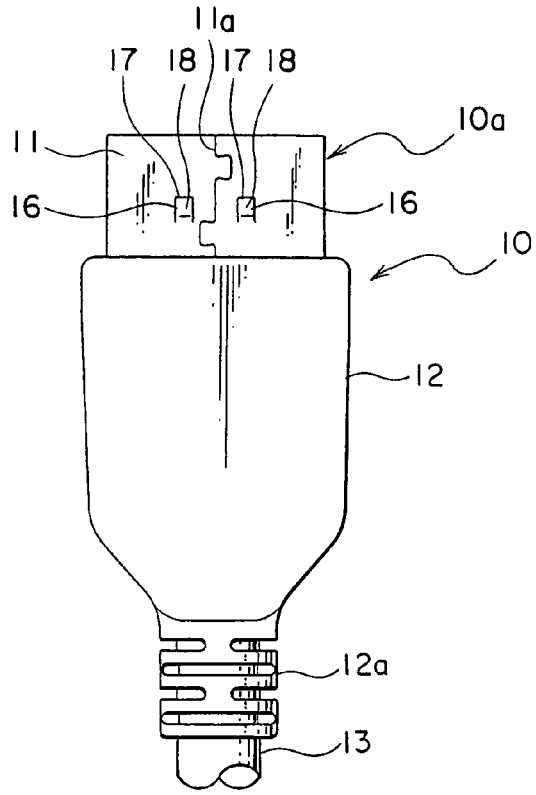
FIG. 3 is a bottom view of the electrical connector illustrated in FIG. 1.
Figure 4:
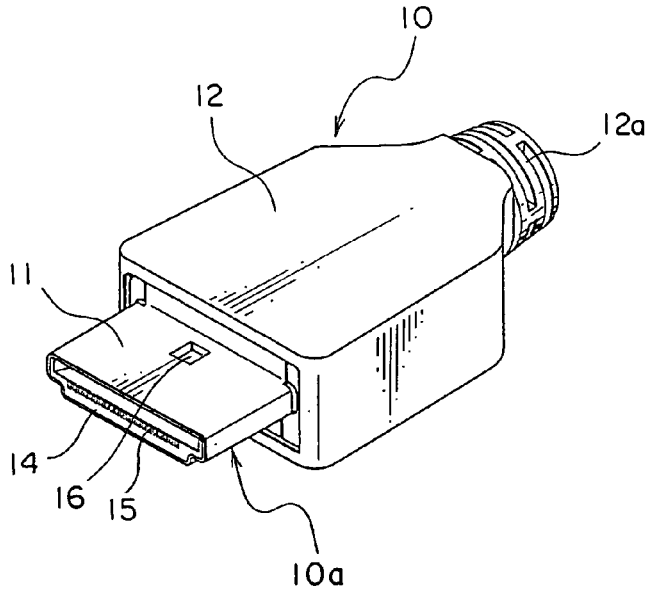
FIG. 4 is a top perspective view of the electrical connector illustrated in FIGS. 1 to 3.
Figure 5:
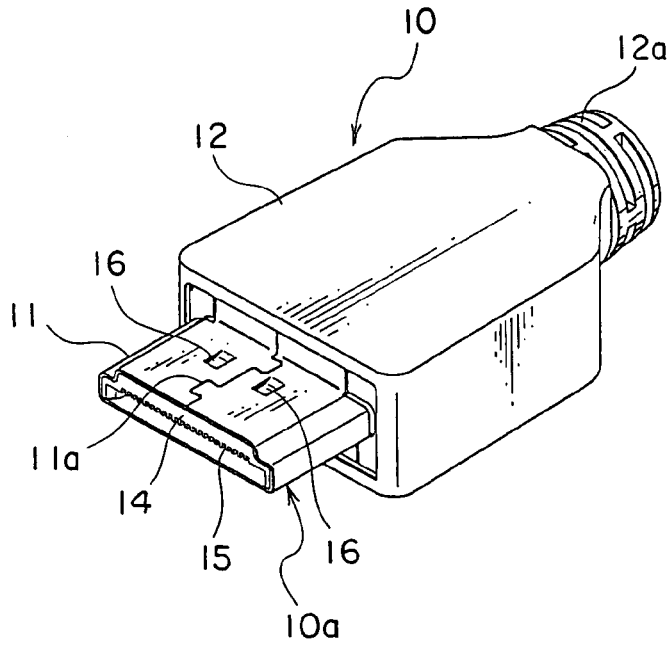
FIG. 5 is a bottom perspective view of the electrical connector illustrated in FIGS. 1 to 3.

Referring to FIGS. 1 to 5, description will be made of an electrical connector according to a first embodiment of this invention. The electrical connector depicted at 10 in the figure is a plug connector to which a cable 13 is connected. Hereinafter, the electrical connector 10 will be called a cable connector.

The cable connector 10 includes an insulating housing 14, a plurality of conductive contacts 15 supported by the housing 14, a shell 11 comprising a box-shaped metal plate coupled to the housing 14 and surrounding the contacts 15, and a resin hood 12 covering a whole of the cable connector 10. The cable 13 comprises a plurality of conductive wires as signal wires and a plurality of shield wires. The signal wires of the cable 13 are connected to one ends of the contacts 15 within the connector 10. The shield wires of the cable 13 are connected to the shell 11. The hood 12 has a cable holding portion 12*a* holding the cable 13.

The shell 11 of the cable connector 10 is formed by bending a sheet metal plate and defines an outer peripheral surface of a plate-like fitting portion 10*a* horizontally extending. The shell 11 has a bonding portion 11*a*.

The shell 11 has a plurality of, i.e., three friction lock grooves 16. One of the three friction lock grooves 16 is disposed on an upper surface of the fitting portion 10*a*. The remaining two friction lock grooves 16 are disposed on a lower surface of the fitting portion 10*a*. Each of the friction lock grooves 16 is a recessed portion formed by utilizing a U-shaped cut formed on the metal plate as a material of the shell, as will later become clear.

Figure 6:
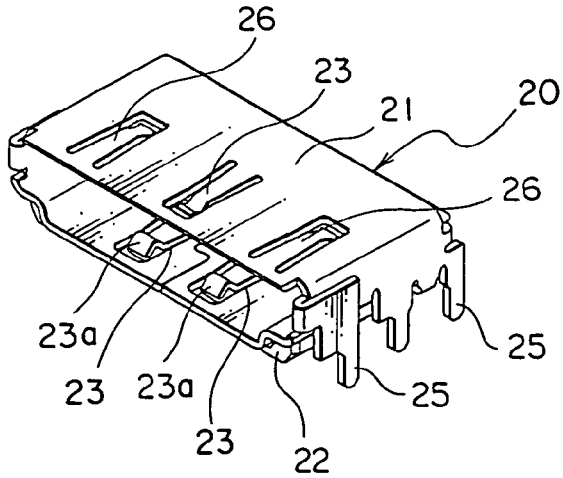
FIG. 6 is a perspective view of a board connector adapted to be connected to the electrical connector illustrated in FIGS. 1 to 5.

Referring to FIG. 6 in addition, description will be made of a mating connector to be connected to the cable connector 10 mentioned above The mating connector depicted at 20 in the figure is a receptacle connector to be connected to a substrate (not shown) and will hereinafter be called a board connector.

The board connector 20 includes a box-shaped conductive shell 21, an insulating housing 22 coupled to the shell 21, and a plurality of conductive contacts (not shown) held by the housing 22. The shell 21 has a plurality of, i.e., three spring members 23 one of which is formed on its upper surface at a center position thereof and the remaining two of which are formed on its lower surface at left and right positions symmetrically spaced from the center, respectively. Further, on opposite sides of the spring member 23 on the upper surface of the shell 21, a pair of spring members 26 are formed to hold the shell 11 of the cable connector 10. A reference numeral 25 represents a leg portion for use in mounting the board connector 20 to the substrate or a ground terminal portion.

Figure 7A:
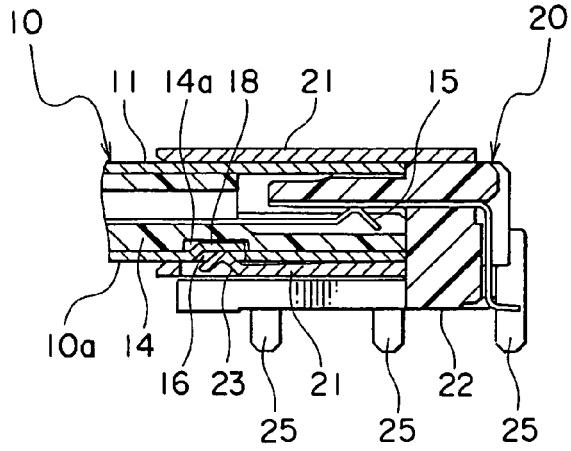
FIGS. 7A and 7B are sectional views, taken at different positions, showing a fitted state of the electrical connector in FIGS. 1 to 5 and the board connector in FIG. 6.
Figure 7B:
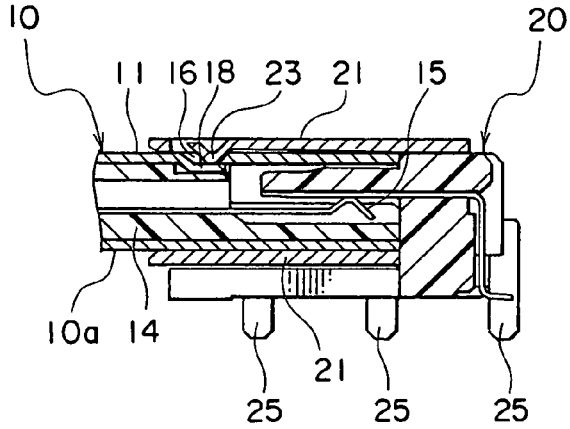
Figure 8:
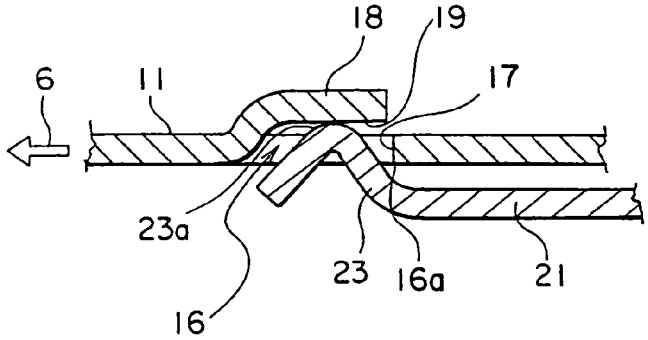
FIG. 8 is an enlarged sectional view of a part of FIG. 7A.

Referring to FIGS. 7A, 7B, and 8 in addition, description will be made of the cable connector 10 further in detail as well as connection between the cable connector 10 and the board connector 20.

In order to form each of the friction lock grooves 16, the above-mentioned U-shaped cut (which is designated by reference numeral 17) is at first formed on the metal plate as the material of the shell 11. Inside the U-shaped cut 17, a tongue member 18 is formed with its one end as a free end. Then, the tongue member 18 is deformed by pressing towards the inside of the shell 11. A depressed portion produced by the deformation forms the bottom 19 of the friction lock groove 16, i.e., the recessed portion. Thus, the U-shaped cut 17 defines a range of the recessed portion.

As a result of deforming the tongue member 18 inward, the shell 11 has a protrusion formed on its inner surface and corresponding to the friction lock groove 16. In order to escape from the protrusion, i.e., in order to avoid interference with the protrusion, the housing 14 is provided with a depression 14*a* accommodating the protrusion.

The tongue member 18 extends from the metal plate as the material of the shell 11 in a direction in which the cable connector 10 is connected to the board connector 20. Specifically, the tongue member 18 extends in a direction opposite to a first direction 6 (see FIGS. 3 and 8) in which the cable connector 10 is removed from the board connector 20.

In order to connect the cable connector 10 to the board connector 20, the fitting portion 10*a* of the cable connector 10 is fitted inside the shell 21 of the board connector 20. When the fitting portion 10*a* is fitted inside the shell 21, the locking portions 23*a* of the spring members 23 are fitted to the friction lock grooves 16 and are brought into press contact with the bottoms 19 by elasticity of the spring members 23.

At an end of each of the friction lock grooves 16, an edge 16*a* is formed by the cut 17. Therefore, by engagement between the friction lock groove 16 and the locking portion 23*a* of the spring member 23, a force of maintaining a fitted state of the connectors can be increased. Even if an unexpected force is applied to the cable connector 10 in the first direction 6, the cable connector 10 is prevented from being easily released.

Further, the locking portion 23*a* of the spring member 23 is brought into press contact with the bottom 19 of the friction lock groove 16. Therefore, the shells 11 and 21 are reliably electrically connected to each other. In addition, the bottom 19 of the friction lock groove 16 is formed by the tongue member 18 so that no hole is formed at that portion of the shell 11. Accordingly, EMI characteristics are improved.

In each of engaged portions between spring members 23 and the friction lock grooves 16, the above-mentioned two functions are achieved, so that a space in the connector can effectively be utilized. In addition, in case where the connector is reduced in size, it is possible to prevent degradation of the performance.

Figure 9:
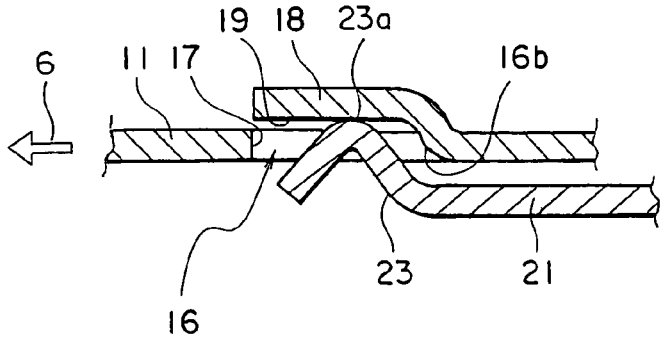
FIG. 9 is a sectional view similar to FIG. 8 and showing a modification of the electrical connector illustrated in FIGS. 1 to 5.

As illustrated in FIG. 9, the tongue member 18 may be formed to extend from the metal plate as the material of the shell 11 in the direction in which the cable connector 10 is removed from the board connector 20, i.e., in the first direction 6. In this case also, when the fitting portion 10*a* is fitted inside the shell 21, the locking portions 23*a* of the spring members 23 are fitted to the friction lock grooves 16 and are brought into press contact with the bottoms 19 by elasticity of the spring members 23. At an end of each friction lock groove 16, a curved portion 16*b* is formed by deformation of the tongue member 18. Therefore, when the cable connector 10 is removed from the board connector 20, the locking portions 23*a* of the spring members 23 can be released or disengaged from the friction lock grooves 16 with a gentle force.

Figure 10:
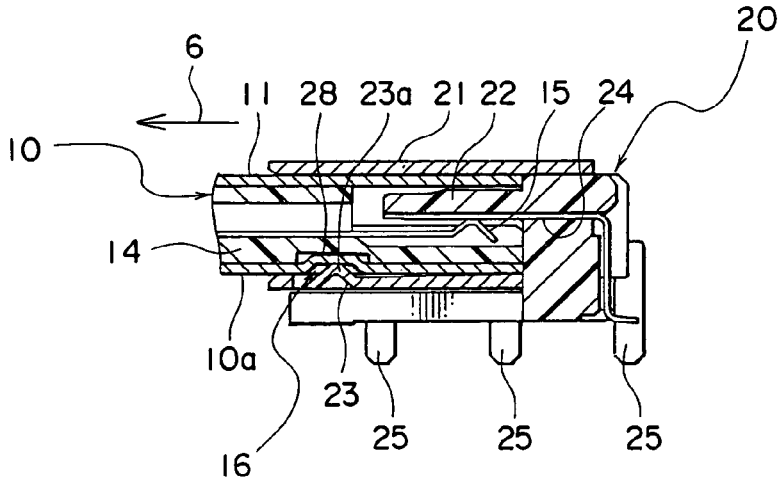
FIG. 10 is a sectional view similar to FIG. 7A and showing another modification of the electrical connector illustrated in FIGS. 1 to 5.
Figure 11:
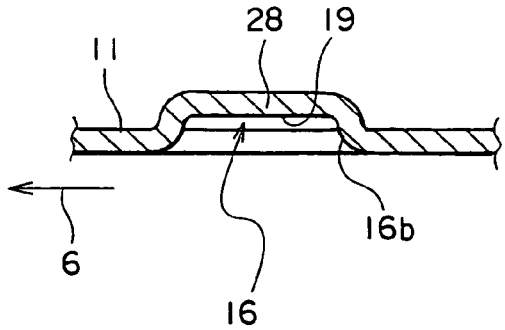
FIG. 11 is an enlarged sectional view of a characteristic part in FIG. 10.

As illustrated in FIGS. 10 and 11, a bridge 28 having opposite ends connected to the shell 11 may be formed instead of the tongue member 18 mentioned above. The bridge 28 is formed between two cuts formed on the metal plate as the material of the shell 11 and parallel to each other. By press working, the bridge 28 is deformed towards the inside of the shell 11. A depressed portion produced by the deformation forms the bottom 19 of the friction lock groove 16. As a result of deforming the bridge 28 inward, the shell 11 has a protrusion formed on its inner surface and corresponding to the friction lock groove 16. In order to escape from the protrusion, i.e., in order to avoid interference with the protrusion, the housing 14 is provided with a depression 14*a* accommodating the protrusion.

In the structure illustrated in FIGS. 10 and 11 also, when the fitting portion 10*a* is fitted inside the shell 21, the locking portions 23*a* of the spring members 23 are fitted to the friction lock grooves 16 and are brought into press contact with the bottoms 19 by elasticity of the spring members 23. At an end of each friction lock groove 16, the curved portion 16*b* is formed by deformation of the bridge 28. Therefore, when the cable connector 10 is removed from the board connector 20, the locking portions 23*a* of the spring members 23 can be released or disengaged from the friction lock grooves 16 with a gentle force.

Figure 12:
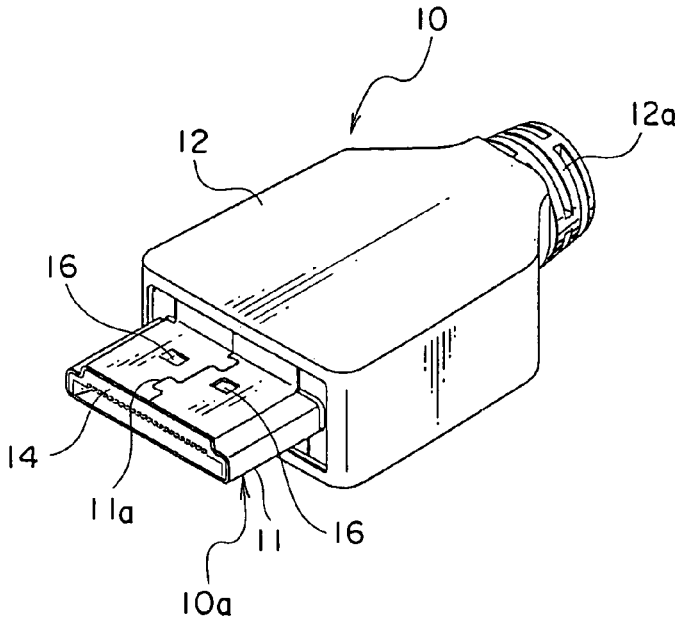
FIG. 12 is a bottom perspective view of an electrical connector according to a second embodiment of this invention.
Figure 13:
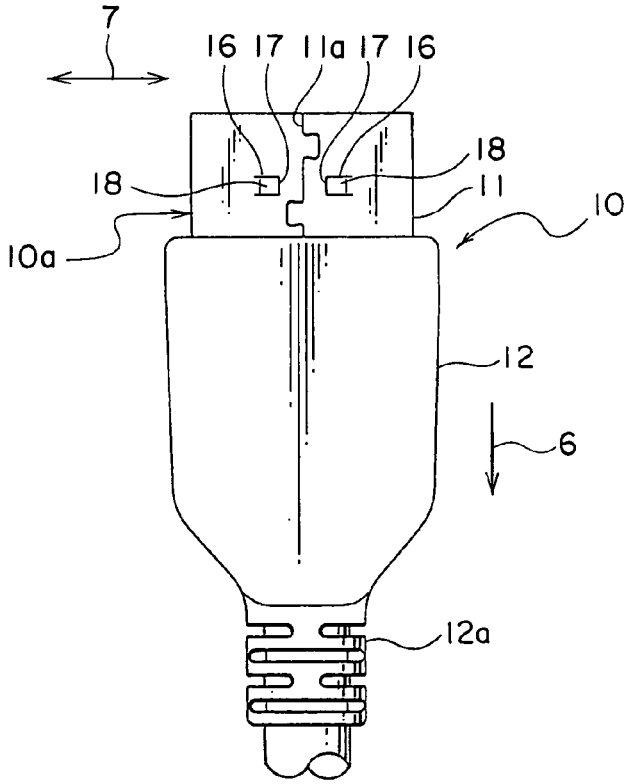
FIG. 13 is a bottom view of the electrical connector illustrated in FIG. 12.
Figure 14:
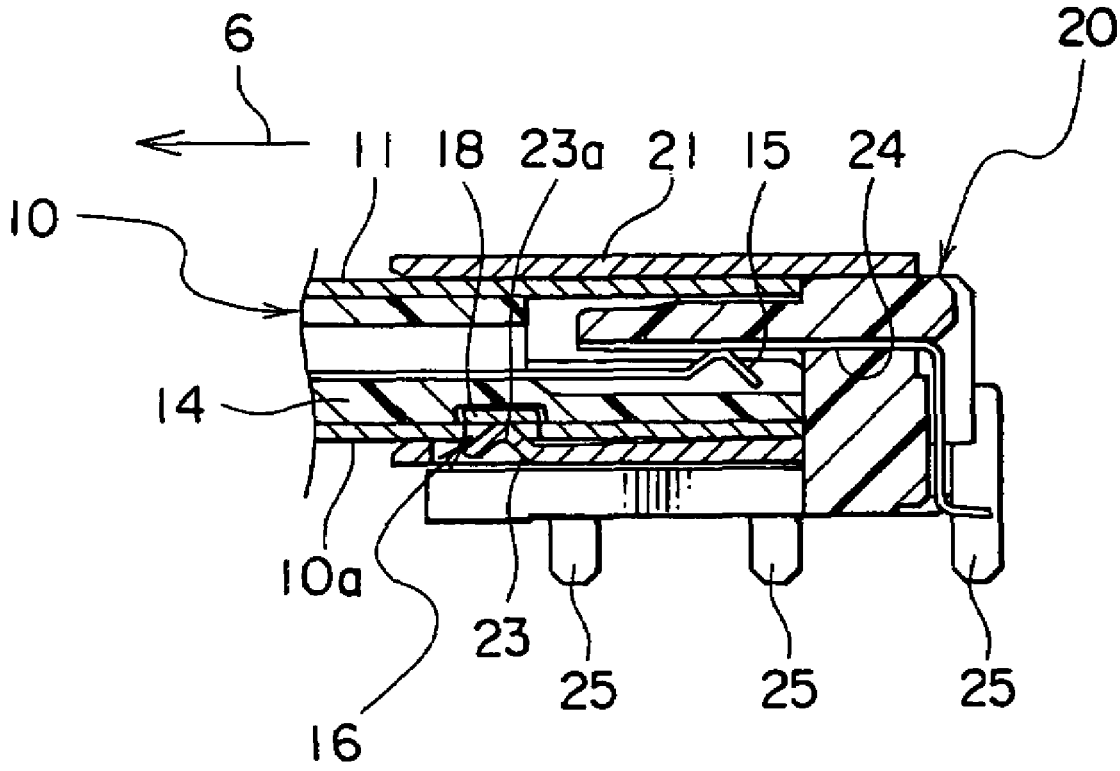
FIG. 14 is a sectional view similar to FIG. 7A and showing a fitted state of the electrical connector in FIG. 12 and the board connector in FIG. 6.

Referring to FIGS. 12 to 14, description will be made of an electrical connector according to a second embodiment of this invention. Similar parts having similar functions are designated by like reference numerals and description thereof will be omitted. The electrical connector in this embodiment is a cable connector also and, therefore, is depicted by a reference numeral 10 same as that of the cable connector illustrated in FIGS. 1 to 5.

In FIGS. 12 to 14, the tongue members 18 of the friction lock grooves 16 extend from the metal plate as the material of the shell 11 in a direction in which the cable connector 10 is removed from the board connector 20, i.e., in a second direction 7 perpendicular to the first direction 6. In particular, on the lower surface of the fitting portion 10*a*, the two tongue members 18 extend from the metal plate as the material of the shell 11 towards each other in the second direction 7. These tongue members 18 are easily obtained by forming the U-shaped cuts 17 in a direction different by 90° from that in the cable connector illustrated in FIGS. 1 to 5.

In order to connect the cable connector 10 to the board connector 20, the fitting portion 10*a* of the cable connector 10 is fitted inside the shell 21 of the board connector 20. When the fitting portion 10*a* is fitted inside the shell 21, the locking portions 23*a* of the spring members 23 are fitted to the friction lock grooves 16 and are brought into press contact with the bottoms 19 by elasticity of the spring members 23.

At an end of each of the friction lock grooves 16, an edge is formed by the cut 17. Therefore, by engagement between the edge and the locking portion 23*a* of the spring member 23, a force of maintaining a fitted state of the connectors can be increased. Even if an unexpected force is applied to the cable connector 10 in the first direction 6, the cable connector 10 is prevented from being easily released.

Further, the locking portion 23*a* of the spring member 23 is brought into press contact with the tongue member 18 of the friction lock groove 16. Therefore, the shells 11 and 21 are reliably electrically connected to each other. In addition, the bottom 19 of the friction lock groove 16 is formed by the tongue member 18 so that no hole is formed at that portion of the shell 11. Accordingly, EMI characteristics are improved.

In each of the engaged portions between the spring members 23 and the friction lock grooves 16, the above-mentioned two functions are achieved so that a space in the connector can effectively be utilized. In addition, in case where the connector is reduced in size, it is possible to prevent degradation of the performance.

In FIGS. 12 to 14, the two tongue members 18 may extend from the metal plate as the material of the shell away from each other in the second direction 7. In the manner similar to that mentioned in connection with FIGS. 11 and 12, the tongue member 18 may be replaced by the bridge 28 having opposite ends connected to the shell.

In the foregoing, description has been directed to the case where the cable connector is provided with the friction lock grooves. Alternatively, the board connector may be provided with the friction lock grooves. In this case, the cable connector is provided with spring members having locking portions.

The friction lock groove may be formed by simply depressing or cutting out a part of the metal shell.

In the foregoing, three friction lock grooves are formed. However, the number of the friction lock grooves is not limited thereto.

This invention is suitable for use as a high-speed transmission interface connector but is applicable to any type of connection such as board-to-board, cable relay connection, and so on.

Although this invention has been described in conjunction with the preferred embodiments thereof, this invention may be modified in various other manners within the scope of the appended claims.

What is claimed is:

1. An electrical connector to be connected to a mating connector, wherein the mating connector includes a spring member having a locking portion for locking a connected state in which the electrical connector is connected to the mating connector, the electrical connector comprising:

a conductive contact;

a housing holding the contact; and a conductive shell which is coupled to the housing and covers the contact;

wherein the shell includes a recessed portion into which the locking portion is received in the connected state, and wherein the recessed portion is recessed from an external surface of the shell to have a bottom for coming into contact with the locking portion and a side for engaging with the locking portion.

2. The electrical connector according to claim 1, wherein the shell is made of a plate material and has a cut defining a range of the recessed portion.

3. The electrical connector according to claim 2, wherein the recessed portion comprises a depressed portion formed by press working of the range defined by the cut.

4. The electrical connector according to claim 2, wherein the cut forms a tongue member having one end as a free end, and the tongue member is deformed from the external surface of the shell to serve as the bottom of the recessed portion.

5. The electrical connector according to claim 4, wherein the tongue member extends from the plate material in a direction in which the mating connector is connected to the electrical connector.

6. The electrical connector according to claim 4, wherein the tongue member extends from the plate material in a direction in which the mating connector is disconnected from the electrical connector.

7. The electrical connector according to claim 4, wherein the tongue member extends from the plate material in a direction perpendicular to a direction in which the mating connector is connected to the electrical connector.

8. The electrical connector according to claim 2, wherein the cut forms a bridge having opposite ends connected to the shell, and the bridge is deformed from the external surface of the shell to serve as the bottom of the groove.

9. The electrical connector according to claim 1, wherein the shell comprises a plate material and includes a protrusion, which protrudes from an inner surface of the shell and which corresponds to the recessed portion, and wherein the housing comprises a depression which accommodates the protrusion.

* * * * *